US006866472B2

(12) United States Patent
Okudera et al.

(10) Patent No.: US 6,866,472 B2
(45) Date of Patent: Mar. 15, 2005

(54) VACUUM PUMP

(75) Inventors: Satoshi Okudera, Narashino (JP); Yoshiyuki Sakaguchi, Narashino (JP)

(73) Assignee: BOC Edwards Technologies Limited, Narashino (JP)

( * ) Notice: Subject to any disclaimer, the term of this patent is extended or adjusted under 35 U.S.C. 154(b) by 0 days.

(21) Appl. No.: 10/387,364

(22) Filed: Mar. 12, 2003

(65) Prior Publication Data

US 2003/0175115 A1 Sep. 18, 2003

(30) Foreign Application Priority Data

Mar. 12, 2002 (JP) ..... 2002-066845

(51) Int. Cl.[7] ..... F01D 1/36
(52) U.S. Cl. ..... 415/90; 415/143
(58) Field of Search ..... 415/90, 55.1, 143

(56) References Cited

U.S. PATENT DOCUMENTS 6,468,030 B2 * 10/2002 Kawasaki ..... 415/90
6,585,480 B2 * 7/2003 Kawasaki et al. ..... 415/90
6,599,108 B2 * 7/2003 Yamashita ..... 417/423.4
6,672,827 B2 * 1/2004 Yamashita et al. ..... 415/90

FOREIGN PATENT DOCUMENTS

EP 0887556 12/1998

OTHER PUBLICATIONS

Patent Abstracts of Japan vol.2000, No. 11, Jan. 3, 2001 JP 2000 220596 A (Osaka Vacuum Ltd), Aug. 8, 2000.
Patent Abstracts of Japan vol.1999, No. 01, Jan. 29, 1999 JP 10 274189 A (Shimadzu Corp), Oct. 13, 1998.
Patent Abstracts of Japan vol.2000, No. 10, Nov. 17, 2000 JP 2000 205183 A (Nitsubishi Heavy Ind Ltd), Jul. 25, 2000.

* cited by examiner

*Primary Examiner*—Hoang Nguyen
(74) *Attorney, Agent, or Firm*—Adams & Wilks

(57) ABSTRACT

A vacuum pump has a rotor mounted to undergo rotation about a rotational axis. A cylindrical base member surrounds a lower outer periphery of the rotor. A cylindrical pump case surrounds an upper outer periphery of the rotor. The base member has an inner periphery, an outer periphery, and a groove formed between the inner and outer peripheries thereof. The pump case is connected to the base member so that a portion of the outer periphery of the base member confronts a portion of the inner periphery of the pump case. A thread groove is formed in the inner periphery of the base member.

20 Claims, 4 Drawing Sheets

PRIOR ART

VACUUM PUMP

BACKGROUND OF THE INVENTION

1. Field of the Invention

The present invention relates to vacuum pumps for use, for example, with semiconductor manufacturing apparatus and, more particularly, to a vacuum pump capable of absorbing and reducing damaging torque when abnormal torque is generated in the pump.

2. Description of the Related Art

During a semiconductor manufacturing operation, a conventional vacuum pump as shown in FIG. 4 is known and used during various process, such as a dry etching process, to exhaust gas from a high-vacuum process chamber for producing a high vacuum.

The vacuum pump of FIG. 4 has a rotor 2 which is rotatably arranged inside an outer casing 1 that connects a cylindrical base member 3 and a cylindrical pump case 4, wherein a blade structure consists of multistage rotor blades 9 on the upper outer periphery of the rotor 2 and multistage stator blades 10 arranged alternately with the rotor blades 9 and functions as a turbo molecular pump by the rotation of the rotor 2, and a spacing structure constituted by the lower outer periphery of the rotor 2 and a thread groove 12 formed in the inner peripheral portion of the base member 3 which opposes thereto functions as a thread groove pump by the rotation of the rotor 2.

With such conventional vacuum pump, however, the rotor 2 may be broken due to stress concentration on the rotor 2 depending on the use conditions. When such a breakage occurs during high speed rotation, the rotation balance of the entire rotation body constituted by the rotor blades 9 and the rotor 2 is lost immediately. Accordingly, the rotor blades 9 may be brought into contact with the inner periphery of the pump case 4 or the lower periphery of the rotor 2 may collide with the inner peripheral portion of the base member 3 to produce damaging torque that applies circumferential torsional rotation to the entire outer casing 1 composed of the pump case 4 and the base member 3, which may break a process chamber 14 or fastening bolts that fasten the pump case 4 to the process chamber 14.

SUMMARY OF THE INVENTION

The present invention has been made to solve the above problems. Accordingly, it is an object of the present invention to provide a vacuum pump capable of absorbing and reducing damaging torque when damaging torque is generated in the pump due to the occurrence of an abnormal state in the pump.

In order to attain the above object, according to a first aspect of the present invention, a vacuum pump is provided which includes a rotatable rotor; a cylindrical base member surrounding the lower outer periphery of the rotor; a cylindrical pump case surrounding the upper outer periphery of the rotor and connected to the base member; multistage rotor blades arranged on the upper outer periphery of the rotor; multistage stator blades arranged alternately with the rotor blades on the inner periphery of the pump case; a thread groove formed on the inner periphery of the base member; and a groove spacing formed between the inner and outer peripheral portions of the base member.

According tot he invention, when the rotor is broken and causes collision between part of the rotor with the inner peripheral portion of the base member during the operation of the vacuum pump, a thicker part of the base member arranged more inside than the groove spacing in the pump case is plastically deformed toward the groove spacing by the impact to absorb the rotational collision energy of the rotor.

According to the invention, the groove spacing may be formed in the shape of a ring disposed around the periphery of the base member.

According to the invention, preferably, a thicker part of the base member arranged more inside than the groove spacing in the pump case is adjusted at a strength to be plastically deformed by the impact when the rotor rotating at high speed collides with the inner periphery of the base member. This is for the purpose of efficiently absorbing the rotational collision energy of the rotor owing to the plastic deformation.

According to the invention, the groove spacing may communicate with the spacing between the rotor blades and the stator blades. With such an arrangement, the groove spacing and the thread groove are communicated with each other through the spacing to decrease the differential pressure between the periphery of the thread groove, that is, the screw pump operation part and the groove spacing. Accordingly, the thread groove can easily be deformed plastically and also the thread groove can sufficiently be made thin so as to be deformed plastically.

According to a second aspect of the present invention, a vacuum pump is provided which includes: a rotatable rotor; a cylindrical base member surrounding the lower outer periphery of the rotor; a cylindrical pump case surrounding the upper outer periphery of the rotor and connected to the base member; multistage rotor blades arranged on the upper outer periphery of the rotor; multistage stator blades arranged alternately with the rotor blades on the inner periphery of the pump case; a thread groove formed on the inner peripheral portion of the base member; and a recess formed on the outer peripheral portion of the base member.

According to the invention, when the rotor is broken to cause collision of part of the rotor with the inner peripheral portion of the base member during the operation of the vacuum pump, a thicker part of the base member arranged more inside than the recess in the pump is plastically deformed by the impact to absorb the rotational collision energy of the rotor.

According to the invention, the recess may be formed in the shape of a ring around the periphery of the base member.

According to the invention, preferably, a thicker part of the base member arranged more inside than the recess is adjusted at a strength to be plastically deformed by the impact when the rotor rotating at high speed collides with the inner peripheral portion of the base member for the reason mentioned above.

According to the invention, the recess may adopt a structure having a protrusion on the inner bottom surface thereof. In this case, the protrusion projects from the inner bottom surface of the recess toward the inner periphery of the pump case opposed thereto and, when the thicker part of the base member arranged more inside than the recess becomes depressed plastically, it is sandwiched by the thicker part of the base member and the inner periphery of the pump case and is crushed.

According to the first and second aspects of the invention, the structure in which the lower portion of the outer periphery of the base member is thicker than the connected portion of the base member with the pump case may be adopted.

DETAILED DESCRIPTION OF THE PREFERRED EMBODIMENTS

Figure 1:
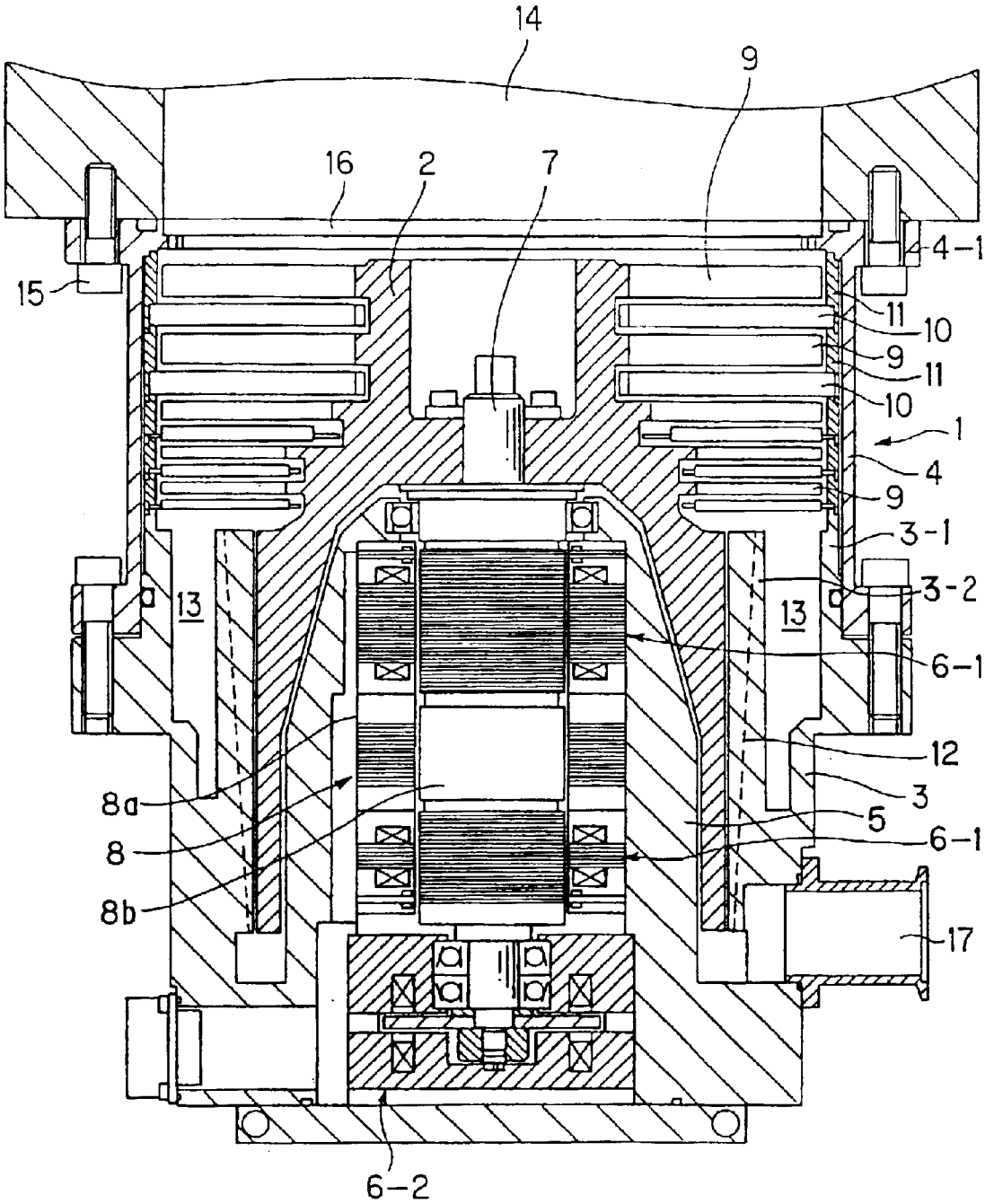
FIG. 1 is a cross sectional view of an embodiment of a vacuum pump according to the present invention.

Referring to FIG. 1, embodiments of a vacuum pump according to the present invention will be specifically described.

FIG. 1 shows a vacuum pump, which is composed of a turbo molecular pump and a thread screw pump with a structure in which a rotor 2 is rotatably arranged inside an outer casing 1.

The outer casing 1 is a cylindrical structure in which a cylindrical base member 3 and a cylindrical pump case 4 are integrated with bolts in the axial direction of the cylinder shaft, in which the rotor 2 is contained.

With the rotor 2 contained in the outer casing 1, the lower outer periphery of the rotor 2 is surrounded by the cylindrical base member 3 that constitutes substantially the lower half of the outer casing 1 and it is opposed to the inner periphery of the base member 3 through a certain narrow spacing. On the other hand, the upper outer periphery of the rotor 2 is surrounded by the cylindrical pump case 4 that constitutes substantially the upper half of the outer casing 1.

In this embodiment, the rotor 2 is also shaped in the form of a cylinder, the rotor 2 contains a stator column 5, and a rotor shaft 7 is rotatably arranged at the center of the stator column 5. The rotor shaft 7 is supported in the radial direction and the axial direction by a magnetic bearing having a radial electromagnet 6-1 and an axial electromagnet 6-2 provided in the stator column 5. The upper portion of the rotor shaft 7 projects from the upper end of the stator column 5, to which the rotor 2 is connected and fixed. Accordingly, in this embodiment, the rotor 2 is integrated with the rotor shaft 7 so as to be rotated around the rotor shaft.

The stator column 5 includes a drive motor 8. The drive motor 8 is composed of a stator element **8*b* being provided inside the stator column 5 and a rotor element 8*b* being provided to the rotor shaft 7, thereby the rotor shaft 7** being rotated around the shaft.

A plurality of rotor blades 9 are fixed in multiple stages to the upper outer periphery of the rotor 2 and a plurality of stator blades 10 are arranged alternately with the rotor blades 9 on the inner periphery of the pump case 4. The blade structure composed of the rotor blades 9 and the stator blades 10 serves as a turbo molecular pump by the rotation of the rotor 2.

Various structures for mounting the stator blades 10 on the inner periphery of the pump case 4 are provided. In this embodiment, a structure in which a plurality of ring-shaped spacers 11 disposed around the inner periphery of the pump case 4 is stacked in multiple stages and one end of each spacer 11 is sandwiched by the upper and lower spacers 11 is adopted.

The base member 3 has a thread groove 12 on the inner peripheral portion thereof. A spacing structure formed of the thread groove 12 and the lower outer periphery of the rotor 2 opposed thereto functions as a thread groove pump by the rotation of the rotor 2.

The base member 3 also has a groove or groove-shaped spacing 13 (hereinafter, referred to as a groove spacing) between the inner and outer peripheries thereof. In this embodiment, the groove spacing 13 has a constant depth from the top end of the base member 3 toward the bottom and is shaped in the form of a ring around the periphery of the base member 3.

Accordingly, in this embodiment, part of the base member 3 has a double cylinder structure having an inner cylinder 3-2 and an outer cylinder 3-1 while sandwiching the groove spacing 13. That is, the inner and outer cylinders 3-1 and 3-2 are tubular portions spaced-apart from one another by a space defined by the groove spacing 13. The inner cylinder 3-2 of the base member 3, that is, a thicker part of the base member 3 arranged more inside than the groove spacing 13 is adjusted at a strength to become plastically depressed or deformed by the impact when the rotor rotating at high speed 2 collides with the inner peripheral portion thereof.

In the vacuum pump according to the present embodiment, the pump case 4 has a flange 4-1 around the upper rim. The flange 4-1 is brought into contact with the rim of the lower opening of the process chamber 14 and bolts 15 that pass through the flange 4-1 are screwed and fixed to the process chamber 14, and thus, the entire vacuum pump is connected and fixed to the process chamber 14.

The top of the pump case 4 that constitutes the outer casing 1 is opened as a gas suction port 16 and one side of the lower part of the base member 3 that constitutes the outer casing 1 has an exhaust pipe serving as a gas exhaust port 17.

The operation of the vacuum pump shown in FIG. 1 will now be described. In the vacuum pump of FIG. 1, when the process chamber 14 is evacuated to some extent by activating an auxiliary pump (not shown) connected to the gas exhaust port 17 and the drive motor 8 is then activated, the rotor shaft 7, the rotor 2 connected the rotor shaft and the rotor blades 9 are rotated at high speed.

The high-rpm uppermost-stage rotor blade 9 imparts a downward momentum to gas molecules that have entered through the gas suction port 16 and the gas molecules having the downward momentum are sent to the next-stage rotor blade 9 by the stator blade 10. The application of the momentum to the gas molecules and the sending operation are repeated in multiple stages, and so, the gas molecules near the gas suction port 16 are moved toward the thread groove 12 on the inner periphery of the base member 3 in sequence and are exhausted. The gas-molecule exhaust operation is thus performed by the interaction of the rotor blades 9 and the stator blades 10.

The gas molecules that have reached the thread groove 12 by the gas-molecule exhaust operation are moved toward the gas exhaust port 17 while being compressed from a intermediate flow to a viscous flow by the interaction of the rotation of the rotor 2 and the thread groove 12, and they are exhausted from the gas exhaust port 17 to the exterior through the auxiliary pump (not shown).

During the operation of the vacuum pump, when the rotor 2 is broken and part of the rotor 2 collides with the inner peripheral portion of the base member 3, the thicker part of the base member 3 arranged more inside than the groove spacing 13, that is, the inner cylinder 3-2 of the base member 3 becomes plastically depressed toward the groove spacing 13 by the impact, thus absorbing the rotational collision energy of the rotor 2.

With the vacuum pump shown in FIG. 1, since the rotational collision energy of the rotor 2 attenuates in the base member 3, the rotational collision energy of the rotor 2 that is transmitted to the entire outer casing 1 constituted by the base member 3 and the pump case 4 is decreased, and accordingly, damaging torque that applies a circumferential torsional rotation to the outer casing 1 is reduced without adding damaging torque reducing components such as a barrier ring. Accordingly, problems due to the damaging torque, such as the breakage of the process chamber 14 and the breakage of the bolts 15 that fasten the pump case 4 to the process chamber 14 do not occur.

While the above-described embodiment adopts a double cylinder structure in which the base member 3 has the ring-shaped groove spacing 13 to absorb the rotational collision energy of the rotor 2, the base member 3 may employ a multiple cylinder structure having double or more cylinders by adding another groove spacing similar to that to the base member 3.

In the embodiment, the groove spacing 13 of the base member 3 is shaped in the form of a ring around the periphery of the base member 3 so that even if the rotor rotating at high speed 2 collides with any portion of the inner peripheral portion of the base member 3, the rotational collision energy of the rotor 2 can efficiently be absorbed. However, a groove spacing having another shape may be adopted. What shape this type of groove spacing 13 is given is determined as appropriate in view of ease of absorption of the rotational collision energy of the rotor 2 in the base member 3.

Figure 2:
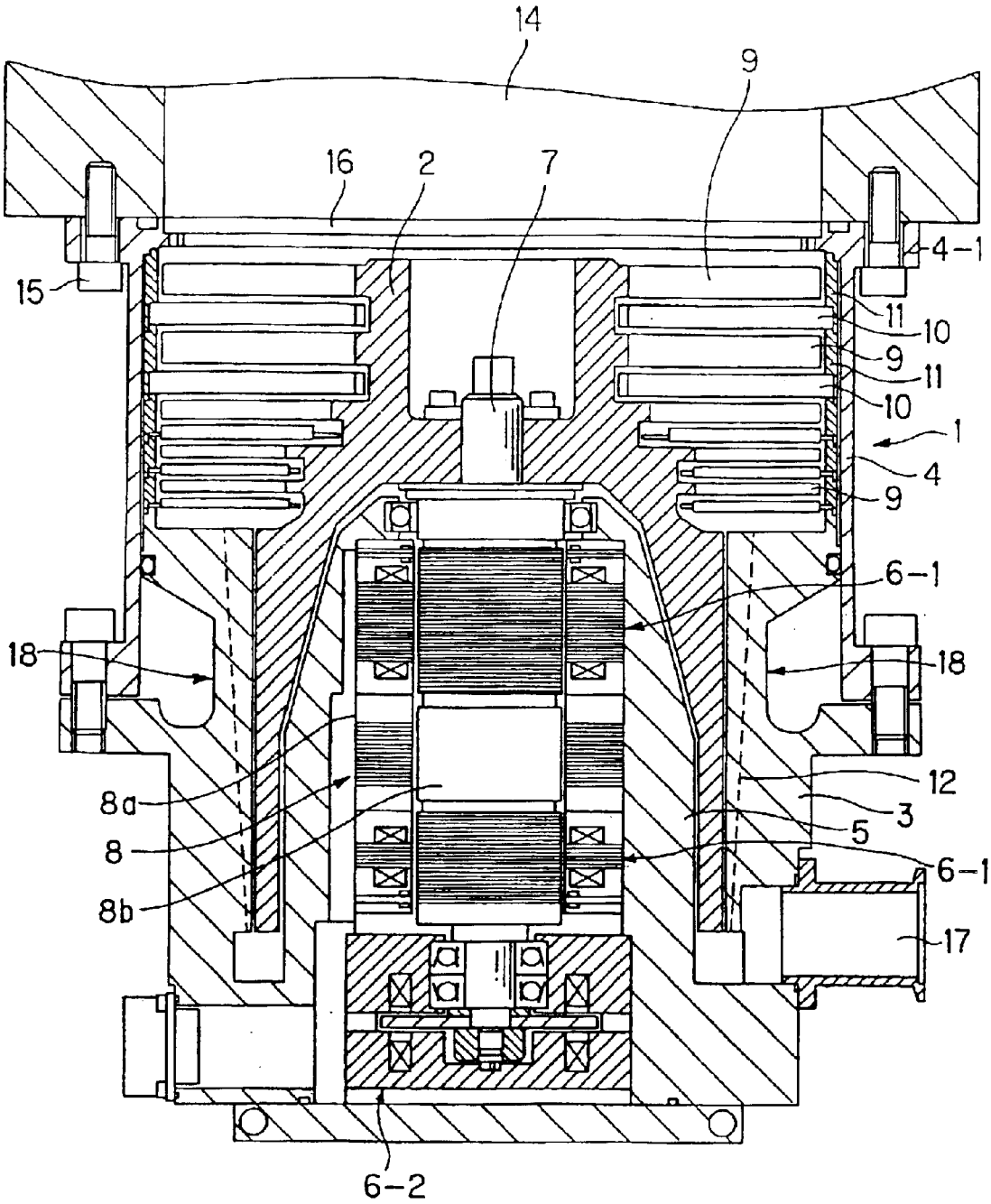
FIG. 2 is a cross sectional view of another embodiment of a vacuum pump according to the present invention.

The embodiment adopts a structure in which the base member 3 has the groove spacing 13 between the inner and outer peripheries thereof as means for reducing damaging torque. However, a recess 18 shown in FIG. 2 may be provided on the outer peripheral portion of the base member 3 in place of the groove spacing 13 or, alternatively, together with the groove spacing 13. In such a case, the recess 18 may be shaped in the form of a ring around the periphery of the base member 3 and the thicker part of the base member 3 arranged more inside than the recess 18 is adjusted at a strength to become plastically deformed by the impact when the rotor rotating at high speed 2 collides with the inner peripheral portion of the base member 3.

With such a structure that employs the recess 18, when part of the rotor 2 collides with the inner periphery of the base member 3, the thicker part of the base member 3 arranged more inside than the recess 18 becomes depressed plastically by the impact to absorb the rotational collision energy of the rotor 2, thus offering an advantage similar to that of the aforesaid embodiment, that is, an advantage of reducing the damaging torque.

Figure 3:
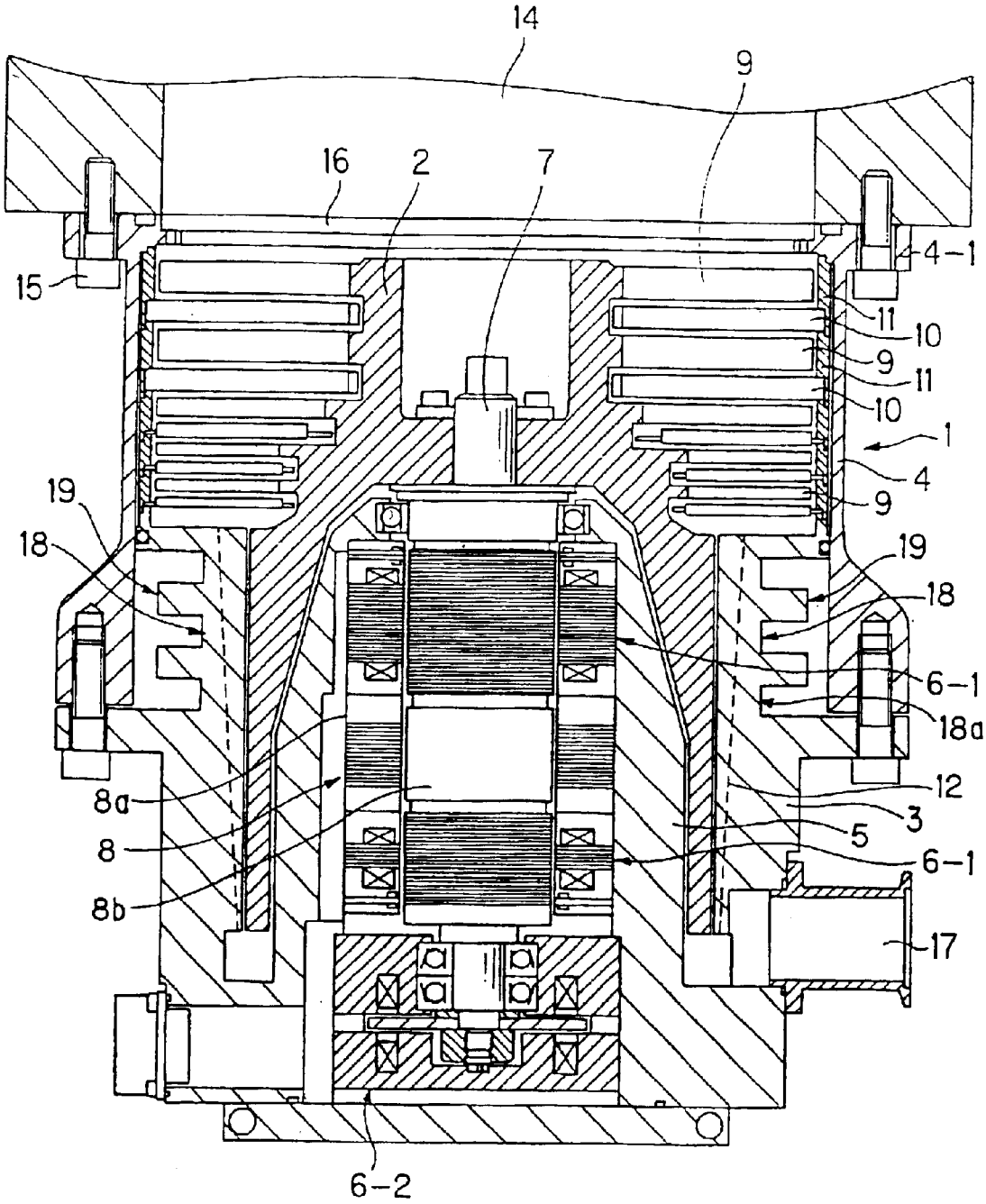
FIG. 3 is a cross sectional view of still another embodiment of a vacuum pump according of the present invention.
Figure 4:
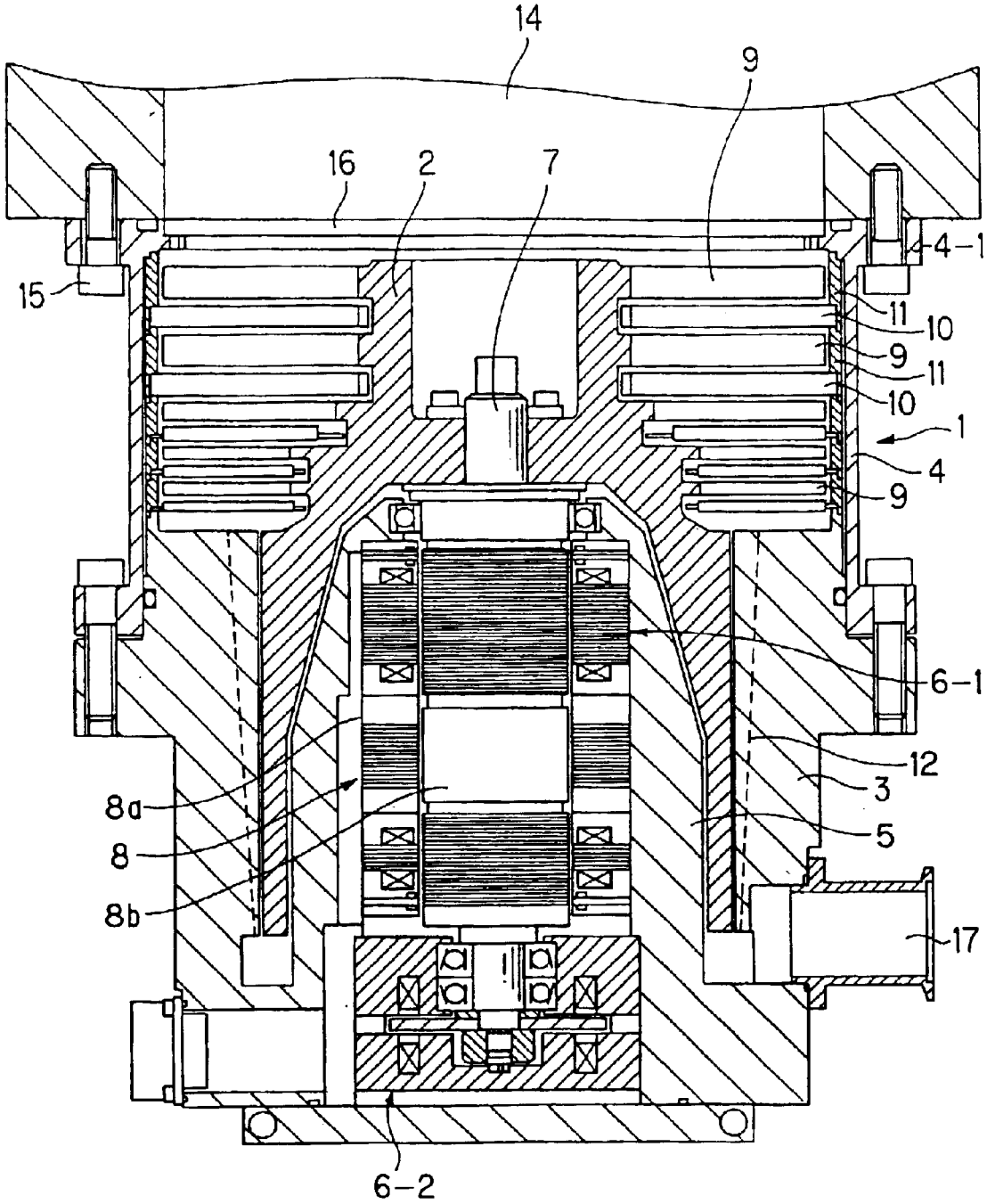
FIG. 4 is a cross sectional view of a related-art vacuum pump.

Also, protrusions 19 may be provided inside the recess 18, as shown in FIG. 3. In this case, the protrusions 19 project from the inner bottom surface 18*a* of the recess 18 toward the inner periphery of the pump case 4 opposite thereto. When the thicker part of the base member 3 arranged more inside than the recess 18 becomes depressed plastically, the protrusions 19 are sandwiched by the thicker portion of the base member 3 and the inner periphery of the pump case 4 and are crushed.

With the aforesaid structure that employs the recess 18 with the protrusions 19, the rotational collision energy of the rotor 2 can be absorbed owing to the plastic depression of the thicker part of the base member 3 arranged more inside than the recess 18 and also the depression of the protrusions 19, and so the damaging torque can be reduced more efficiently.

In the foregoing embodiments, the base member 3 has a base portion on the outer peripheral lower portion that is thicker than the connected portion of the base member with the pump case 4. With such an arrangement, the pump case 4 and the base member 3 are not separated when damaging torque is produced.

The groove spacing 13, the recess 18, and the recess 18 with the protrusions 19 of the base member 3 are provided in the thicker part on the outer periphery of the thread groove 12 of the base member 3. With such an arrangement, even if the rotor 2 is broken to break the periphery of the thread groove 12 owing to the plastic deformation, the groove spacing 13, the recess 18, and the recess 18 with the protrusions 19 interrupt the advance of the plastic deformation, thus preventing the breakage of the pump case 4 and the outer peripheral portion of the base member 3.

When the groove spacing 13 is communicated with the spacing (the operation part of the turbo molecular pump) formed between the rotor blades 9 and the stator blades 10, as shown in FIG. 1, the groove spacing 13 and the thread groove 12 are connected and communicated with each other through the spacing to decrease the differential pressure between the periphery of the thread groove 12, that is, a thread groove pump operation part and the groove spacing 13. Accordingly, the thread groove 12 can easily be deformed plastically and also the thread groove 12 can sufficiently be made thin so as to be deformed plastically.

The vacuum pump according to the invention adopts a structure in which a groove spacing is formed between the inner and outer peripheries of the base member or, alternatively, a structure in which a recess is formed on the outer peripheral portion of the base member. Accordingly, during the operation of the vacuum pump, when the rotor is broken and part of the rotor collides with the inner peripheral portion of the base member, a thicker part of the base member arranged more inside than the groove spacing in the pump case becomes plastically depressed toward the groove spacing by the impact, thus absorbing the rotational collision energy of the rotor. Alternatively, a thicker part of the base member arranged more inside than the recess becomes plastically depressed to absorb the rotational collision energy of the rotor. Consequently, advantages are offered in that the rotational collision energy of the rotor to be transmitted to the entire outer casing constituted by the base member and the pump case is decreased to reduce the damaging torque that applies circumferential torsional rotation to the entire outer casing.

What is claimed is:

1. A vacuum pump comprising:

a rotor mounted to undergo rotation about a rotational axis, the rotor having an upper outer periphery and a lower outer periphery;

a cylindrical base member surrounding the lower outer periphery of the rotor, the base member having an inner periphery, an outer periphery, and a groove formed between the inner and outer peripheries thereof;

a cylindrical pump case surrounding the upper outer periphery of the rotor, the pump case having an inner periphery and being connected to the base member so that a portion of the outer periphery of the base member confronts a portion of the inner periphery of the pump case;

a plurality of multistage rotor blades arranged on the upper outer periphery of the rotor;

a plurality of multistage rotor blades arranged on the inner periphery of the pump case, the stator blades and the rotor blades being alternately disposed in spaced-apart relation to one another; and a thread groove formed in the inner periphery of the base member.

2. A vacuum pump according to claim 1; wherein the groove is generally ring-shaped and is disposed around portions of each of the inner and outer peripheries of the base member.

3. A vacuum pump according to claim 1; wherein the base member has a first portion connected to the pump case and a second portion spaced apart from the first portion by the groove and disposed closer to the rotor than the first portion; and wherein the second portion of the base member comprises a deformable portion which deforms into the groove due to an impact on the base member resulting when the rotor collides with the inner periphery of the base member during rotation of the rotor at a high speed.

4. A vacuum pump according to claim 1; wherein the groove of the base member is disposed in communication with the spacing between the rotor blades and the stator blades.

5. A vacuum pump comprising:

a rotor mounted to undergo rotation, the rotor having an upper outer periphery and a lower outer periphery;

a cylindrical pump case surrounding the upper outer periphery of the rotor and having an inner periphery;

a cylindrical base member surrounding the lower outer periphery of the rotor and connected to the pump case with a plurality of bolts, the base member having an inner periphery, an outer periphery, and a recess formed in the outer periphery thereof and disposed opposite to a portion of the inner periphery of the pump case;

a plurality of multistage rotor blades arranged on the upper outer periphery of the rotor;

a plurality of multistage stator blades arranged on the inner periphery of the pump case, the stator blades and the rotor blades being alternately disposed; and a thread groove formed in the inner periphery of the base member.

6. A vacuum pump according to claim 5; wherein the recess is generally ring-shaped and is disposed around portions of each of the inner and outer peripheries of the base member.

7. A vacuum pump according to claim 5; wherein the base member comprises a deformable portion which deforms into the recess due to an impact on the base member resulting when the rotor collides with the inner periphery of the base member during rotation of the rotor at a high speed.

8. A vacuum pump according to claim 5; wherein the base member has a plurality of surface portions defining the recess; and wherein the base member has a plurality of protrusions extending from one of the surface portions in a direction toward the inner periphery of the pump case.

9. A vacuum pump according to claim 5; wherein the base member has a first portion connected to the pump case and a second portion disposed closer to the lower outer periphery of the rotor than the first portion, the second portion having a thickness greater than that of the first portion.

10. A vacuum pump according to claim 2; wherein the base member has a first portion connected to the pump case and a second portion disposed closer to the lower outer periphery of the rotor than the first portion, the second portion having a thickness greater than that of the first portion.

11. A vacuum pump according to claim 1; wherein the groove of the base member extends from an upper end to a lower end thereof in a direction of the longitudinal axis of the rotor.

12. A vacuum pump comprising:

a casing having a pump case and a base member connected to the pump case, the base member having a base portion, a first tubular portion extending from the base portion, and a second tubular portion extending from the base portion and spaced apart from the first tubular portion to define a space therebetween;

a rotor mounted in the casing for undergoing rotation, the rotor having an upper outer periphery and a lower outer periphery;

a plurality of rotor blades mounted on the upper outer periphery of the rotor;

a plurality of stator blades mounted on an inner periphery of the pump case, the stator blades and the rotor blades being alternately disposed; and a thread groove formed in an inner periphery of the second tubular portion of the base member.

13. A vacuum pump according to claim 12; wherein the pump case surrounds the upper outer periphery of the rotor and the base member surrounds the lower outer periphery of the rotor.

14. A vacuum pump according to claim 12; wherein the second tubular portion of the base member is configured to be deformed toward the space between the first and second tubular portions for absorbing a rotational collision energy of the rotor.

15. A vacuum pump comprising:

a rotor mounted to undergo rotation about a rotational axis, the rotor having an upper outer periphery and a lower outer periphery;

a base member surrounding the lower outer periphery of the rotor, the base member having an inner periphery and an outer periphery;

a pump case surrounding the upper outer periphery of the rotor and being connected to the base member;

a plurality of rotor blades arranged on the upper outer periphery of the rotor;

a plurality of stator blades arranged on the inner periphery of the pump case, the stator blades and the rotor blades being alternately disposed;

a thread groove formed in the inner periphery of the base member; and absorbing means formed in the base member for absorbing a rotational collision energy of the rotor when the rotor is broken and part of the rotor collides with the inner periphery of the base member.

16. A vacuum pump according to claim 15; wherein the absorbing means comprises a groove formed in the base member between the inner and outer peripheries thereof and a portion of the base member for undergoing deformation in the direction of the groove to absorb the rotational collision energy of the rotor when the rotor collides with the inner periphery of the base member.

17. A vacuum pump according to claim 16; wherein the groove is generally ring-shaped.

18. A vacuum pump according to claim 15; wherein the absorbing means comprises a recess formed in the outer periphery of the base member, and a portion of the base member for undergoing deformation in the direction of the recess to absorb the rotational collision energy of the rotor when the rotor collides with the inner periphery of the base member.

19. A vacuum pump according to claim 18; wherein the base member has a plurality of deformable protrusions extending into the recess from a surface of the portion of the base member in a direction toward the inner periphery of the pump case so that the deformable protrusions are deformed between the portion of the base member and the inner periphery of the pump case when the portion of the base member is deformed in the direction of the recess.

20. A vacuum pump according to claim 15; wherein the base member is connected directly to the pump case.

* * * * *